United States Patent [19]

White

[11] 4,248,352

[45] Feb. 3, 1981

[54] WIRE POCKET DISPLAY DEVICE

[75] Inventor: Elzie T. White, Old Hickory, Tenn.

[73] Assignee: Nashville Wire Products Manufacturing Co., Nashville, Tenn.

[21] Appl. No.: 33,858

[22] Filed: Apr. 27, 1979

[51] Int. Cl.³ ..... A47F 5/01

[52] U.S. Cl. ..... 211/88; 211/106; 248/220.4

[58] Field of Search ..... 211/106, 181, 88, 50, 211/51, 52, 55; 248/220.4, 221.1, 221.2, 221.4

[56] References Cited

U.S. PATENT DOCUMENTS

| | | | |
|---|---|---|---|
| 1,970,868 | 8/1934 | Rubenstein | 211/50 X |
| 3,115,252 | 12/1963 | Senical | 211/55 |
| 3,167,287 | 1/1965 | Collins | 211/106 X |
| 3,404,783 | 10/1968 | Whitman et al. | 211/88 |
| 3,532,318 | 10/1970 | Lloyd | 211/181 X |
| 3,682,426 | 8/1972 | Owen | 248/220.4 |

*Primary Examiner*—Ramon S. Britts
*Assistant Examiner*—Robert W. Gibson, Jr.
*Attorney, Agent, or Firm*—Harrington A. Lackey

[57] ABSTRACT

A wire pocket display device including a wire frame receptacle having a pair of laterally spaced pegs projecting rearward therefrom for reception within a pair of laterally spaced apertures in an upright support member, in which at least one of the pegs is laterally movable relative to the receptacle so that the pegs may be received within horizontally spaced apertures of different spacing.

2 Claims, 4 Drawing Figures

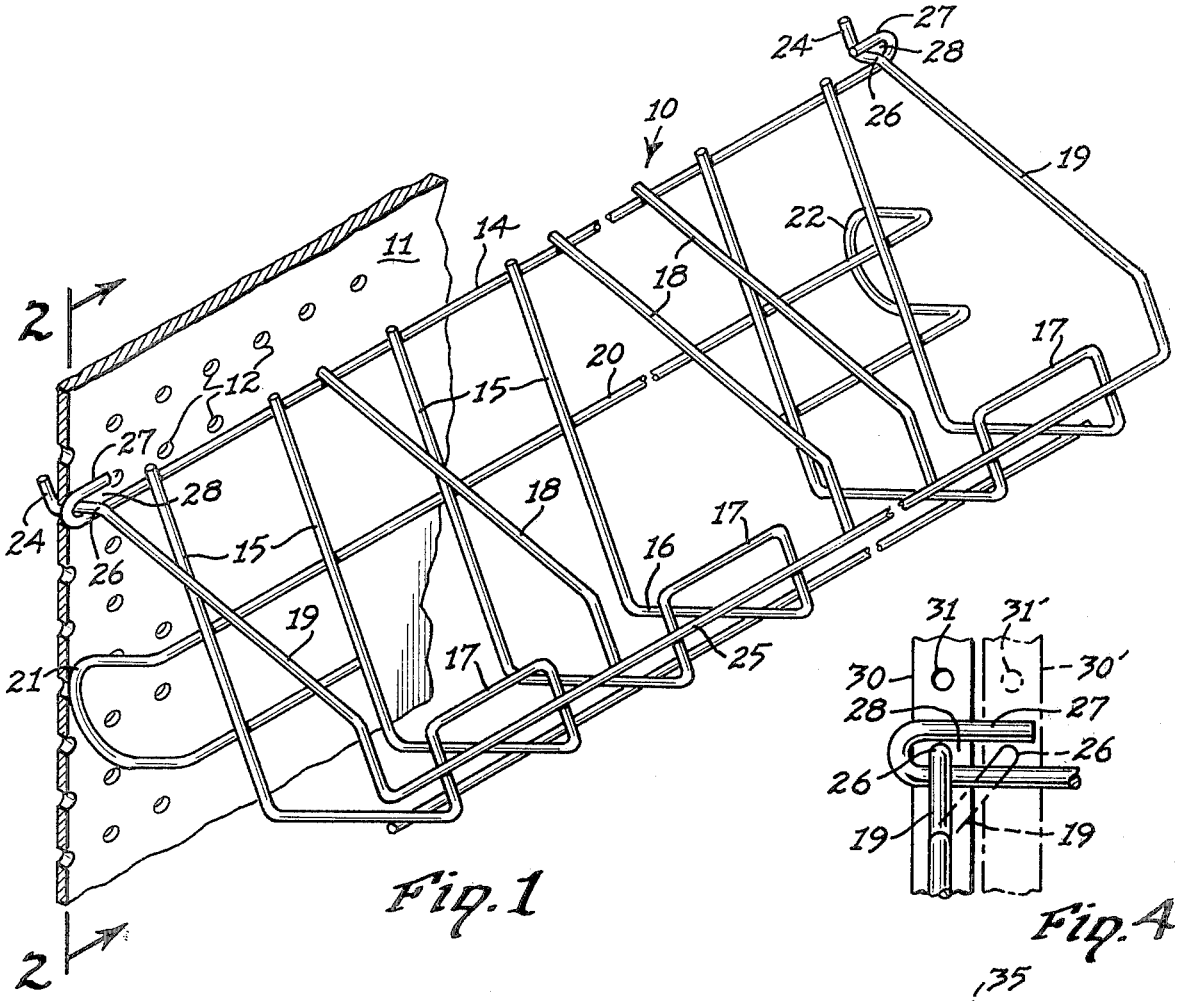
Fig. 1
Fig. 4
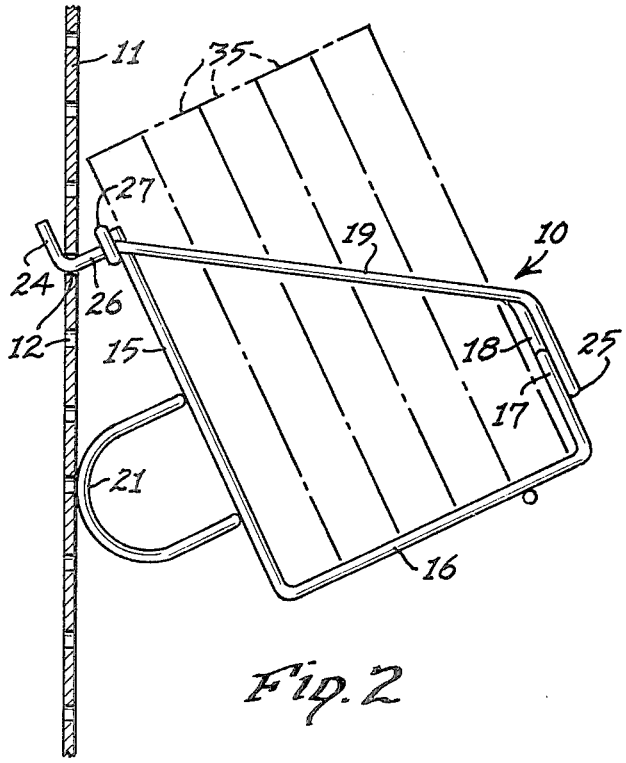
Fig. 2
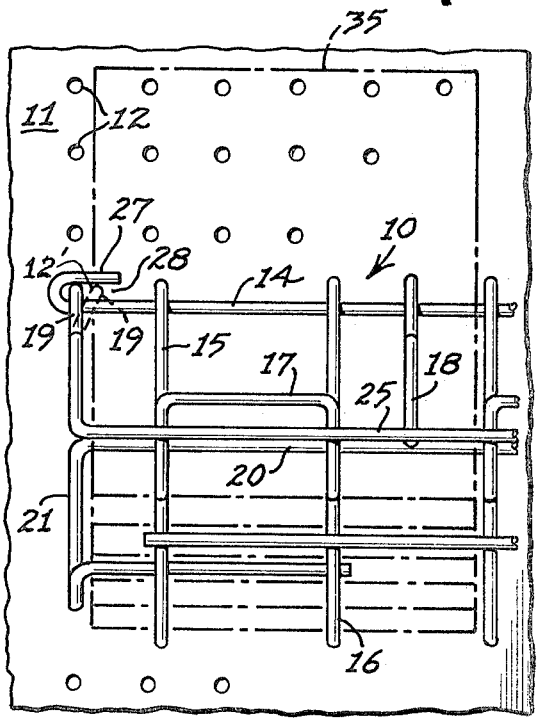
Fig. 3

WIRE POCKET DISPLAY DEVICE

BACKGROUND OF THE INVENTION

This invention relates to a display device, and more particularly to a wire pocket display device.

Wire pocket display devices are well known in the art. These display devices include receptacles made entirely of wire frames having one or more pockets for receiving an article to be displayed, and having rearward projecting pegs for reception within the holes in the standards of a metal frame or within the holes of a pegboard.

However, conventional wire pocket display receptacles include rearward projecting pegs which have a uniform horizontal spacing, and therefore can only be fitted or mounted upon frames or pegboards in which the spacing between the mating apertures are equal to the spacing between the pegs. Thus, in many instances, the wire pocket display devices of one manufacturer cannot be mounted upon the pegboard or metal frames or fixtures of another manufacturer.

SUMMARY OF THE INVENTION

It is therefore an object of this invention to provide a wire pocket display device having a pair of rearward projecting pegs, in which at least one of the pegs is laterally movable so that the device may be mounted upon standards or pegboards having peg apertures of varying spacings.

More specifically, the wire pocket display device made in accordance with this invention includes a pair of semi-rigid but flexible end wire rods projecting along the sides or ends of the display device or receptacle and rearward from the receptacle to terminate in pegs. The flexible wire rods are not welded or otherwise fixed to any portion of the receptacle, so that each of the end wire rods may be laterally flexed to laterally adjust the pegs to fit peg holes of varied spacings or gauges.

The end wire rods are preferably received within vertically disposed, lateral guide slots to limit at least the outward movement of each of the end rods and pegs.

BRIEF DESCRIPTION OF THE DRAWINGS

FIG. 1 is a front perspective view of a wire pocket display device made in accordance with this invention mounted upon a vertically disposed pegboard, shown fragmentarily;

FIG. 2 is a slightly enlarged section taken along the line 2—2 of FIG. 1;

FIG. 3 is a fragmentary front elevation of the display device mounted upon the pegboard disclosed in FIG. 1, and illustrating the lateral adjustability of one of the pegs; and FIG. 4 is a greatly enlarged fragmentary front elevation of the peg portion of the display device mounted upon one standard of a conventional metal frame, and illustrating in phantom the mounting of the peg on another metal frame of different gauge or spacing.

DESCRIPTION OF THE PREFERRED EMBODIMENTS

Referring now to the drawings in more detail, FIGS. 1-3 disclose a wire pocket display device 10 made in accordance with this invention mounted upon a pegboard 11 having peg holes or apertures 12 therein, and disposed in an upright or vertical plane.

The pocket display device 10 is a frame or receptacle made entirely of wire rods including a top horizontal rear rod member 14, vertical rear rod portions 15, bottom rod portions 16 and front looped wire portions 17. These rod portions 14–17 form the back, bottom and front walls of the open top receptacles. The receptacle is divided into separate compartments or pockets by the forward declining partition rods 18 and the end wire rod members 19.

A long horizontal back rod member 20 is bent at its ends to project rearwardly to form looped end members 21 and 22 to rest against the upright support member or pegboard 11 in order to mount the display device 10 at an angle to the pegboard 11, as best disclosed in FIG. 2.

The rear end of each of the end rod members 19 projects rearwardly from the plane of the rear wall of the receptacle device 10 defined by the rods 14, 15 and 20 to form L-shaped pegs 24, each of which is adapted to extend through a peg hole 12 in order to support the display device 10 in a stable position as disclosed in FIGS. 1, 2 and 3.

The parts thus far disclosed and described are known in the art of wire pocket display devices.

The difference between the prior art display devices and the display device 10 is that none of the pegs 24 of the device 10, nor any portion of the end rod members 19, is welded or otherwise fixed to any part of the receptacle 10, except through its integral rod extension into the front rod member 25 fixed to the front looped rod portions 17.

The shank portion 26 of the peg 24 projecting directly from the end rod member 19 rests upon the top rear rod member 14. However, the shank portion 26 is not fixed to any part of the rod member 14 and is thereby permitted to be flexed laterally by manual pressure so that either or both of the pegs 24 may be fitted into or received by a peg hole 12 in a pair of laterally spaced pairs of peg holes of different spacings.

The ends of the rod member 14 terminate in reverse bights or loops 27 to form vertically disposed, laterally opposed, open-ended slots 28. These slots 28 permit the shanks 26 to move laterally toward and away from each other upon the rod member 14, but limit the vertical movement of the shank 26 and the peg 24.

As illustrated in FIG. 3, if the display device 10 is mounted upon a pegboard 11 having more narrowly spaced slots, then the left end rod member 19 is manually pressed or forced toward the right so that the shank 26 moves across the top of the rod member 14 and the peg 24 will register with the respective peg hole 12' for insertion. Either the left end rod member 19 and/or the right rod member 19 may be moved inwardly an appropriate distance until the left and right pegs 24 have the same spacing as the corresponding peg holes 12 into which the pegs 24 are to be inserted.

In FIG. 4, the left end portion of the display device 10 is illustrated fragmentarily mounted upon the left standard or upright 30 of a conventional display stand having apertures or peg holes 31. The left end rod member 19 is disclosed in phantom flexed to an inboard position in order to register with a peg hole 31' of a standard 30' of a frame having a more narrow gauge than the frame including the solid-line upright 30.

Thus, a wire pocket display device 10 has been devised which is capable of being mounted upon pegboards 11 or upright standards 30 or frames or other upright members having pairs of vertically spaced columns of peg holes of varying gauges or horizontal spacing.

Each of the pockets formed in the receptacle 10 by the declining partition rods 18 may support articles for displays, such as the pocket-size paperback books 35, as disclosed in FIGS. 2 and 3.

What is claimed is:

1. A display device adapted to be supported upon an upright support member having a pair of laterally spaced columns of vertically spaced uniform apparatus, comprising:

(a) a display receptacle for receiving at least one article for display, (b) first and second pegs projecting rearward from said receptacle and having a normal lateral spacing, (c) each peg being an elongated, yieldable, semi-rigid, flexible wire rod, of uniform size, and adapted to be received in an aperture in the support member so that when both said pegs are received in laterally spaced apertures, said display receptacle is mounted in a stable position on said support member, (d) at least one of said flexible wire rods being laterally movable relative to said receptacle to be received in an aperture in one column having a lateral spacing from an aperture in the other column different from said normal lateral spacing, and (e) a vertically disposed, laterally extending, guide slot in said receptacle receiving said flexible wire rod for lateral movement.

2. The invention according to claim 1 further comprising a horizontal rear wire in said receptacle forming a loop defining said guide slot.

* * * * *